US007955571B2

(12) United States Patent
Liu

(10) Patent No.: US 7,955,571 B2
(45) Date of Patent: Jun. 7, 2011

(54) INTERMITTENTLY OPENED CRACKING CRUDE OIL APPARATUS

(75) Inventor: Jinzhong Liu, Guangdong (CN)

(73) Assignee: China Academy of Sciences Guangzhou Earth Chemistry Research Institute, Guangzhou, Guangdong Province (CN)

( * ) Notice: Subject to any disclaimer, the term of this patent is extended or adjusted under 35 U.S.C. 154(b) by 230 days.

(21) Appl. No.: 12/433,062

(22) Filed: Apr. 30, 2009

(65) Prior Publication Data

US 2009/0297411 A1 Dec. 3, 2009

(30) Foreign Application Priority Data

May 27, 2008 (CN) ..... 2008 1 0028318

(51) Int. Cl.

| | |
|---|---|
| ***B01J 19/00*** | (2006.01) |
| ***B01J 3/00*** | (2006.01) |
| ***F16K 31/12*** | (2006.01) |
| ***F16K 31/122*** | (2006.01) |

(52) U.S. Cl. ..... 422/240; 422/241; 422/242

(58) Field of Classification Search ..... 422/240, 422/241, 242; 585/400, 50, 734
See application file for complete search history.

(56) References Cited

U.S. PATENT DOCUMENTS

| | | | | |
|---|---|---|---|---|
| 2,108,786 | A * | 2/1938 | Bigelow et al. | 415/199.1 |
| 3,094,141 | A * | 6/1963 | Maienknecht | 137/505.25 |
| 5,073,666 | A * | 12/1991 | Zemanian et al. | 585/734 |
| 5,167,930 | A * | 12/1992 | Fassbender | 422/112 |
| 5,552,039 | A * | 9/1996 | McBrayer et al. | 210/90 |
| 2005/0169815 | A1 * | 8/2005 | van den Brink et al. | 422/130 |

* cited by examiner

*Primary Examiner* — Walter D Griffin
*Assistant Examiner* — Huy-Tram Nguyen
(74) *Attorney, Agent, or Firm* — Global IP Services; Tianhua Gu

(57) ABSTRACT

The present invention discloses an intermittently opened cracking crude oil apparatus comprising a high pressure container (1), a support post (2) and a gold sleeve (3). A sealed reaction chamber of natural gas (4) is formed between an exterior surface of the support post and an interior surface of the gold sleeve, and a sealed high pressure chamber (5) is formed between an interior surface of the high pressure container and an exterior surface of the gold sleeve. A gas outlet is provided in the support post and communicates the reaction chamber of natural gas, the gas outlet communicating a gas conduit (7), the gas conduit being connected to a natural gas collector (8). A movable valve needle (9) is provided on the gas outlet to control open and close of the gas outlet. A liquid inlet (10) is provided on the high pressure container and communicates the high pressure chamber, the liquid inlet communicating a liquid conduit (11) which communicates a high pressure liquid supply. A heater (12) and a nozzle of liquid nitrogen (13) are provided outside the high pressure container. A thermocouple (14) is provided on the high pressure container, the thermocouple being connected to a temperature control (15) which can control operating conditions of the heater and the nozzle of liquid nitrogen.

13 Claims, 1 Drawing Sheet

INTERMITTENTLY OPENED CRACKING CRUDE OIL APPARATUS

CROSS REFERENCE TO RELATED PATENT APPLICATION

The present application claims the priority of the Chinese patent application No. 200810028318.5 filed on May 27, 2008, which application is incorporated herein with reference.

FIELD OF THE INVENTION

The present invention relates to a cracking apparatus, and more particularly, to an intermittently opened cracking crude oil apparatus to perform an experiment of cracking crude oil.

BACKGROUND OF THE INVENTION

On the geothermal action, organic matters in a stratum firstly generate crude oil, and if the temperature further rise, the crude oil will crack to generate natural gas. During the process of the crude oil changing into the natural gas, the gas can flow out of interspaces or crannies of rock, continuously or intermittently, due to continuous increasing of the gas pressure, while the un-cracking crude oil continues the cracking process at its original locations. In the research of oil and gas geochemistry, an experiment method is needed to research the cracking process of crude oil.

The existing manpower simulation experiment is much different from the natural geological conditions. At the natural geological conditions, the crude oil experience a very slow process with the lower temperature (less than 200° C.) and long time (from millions of years to hundreds of millions of years), and at such a lower temperature, the crude oil can maintain liquid and locally continue its cracking process. However, under the manpower simulation conditions, the time can not be too long (generally, from 2 to 20 days) and the reaction temperature, the range of which is typically 300° C. to 700° C., has to be increased in order to compensate the insufficiency of time. At such a high temperature, the crude oil has been boiled before cracking. In this case, if a reaction container is not closed, the boiled crude oil will escape from the container, which causes stop of the cracking process. For this reason, at present crude oil cracking experiments commonly use closed containers at home and abroad. That is, the container is not opened until the reaction is over, and after the reaction is over, the container is opened to remove the gas. However, this method apparently does not comply with the rule that the gas generated by cracking discharges continuously or intermittently.

SUMMARY OF THE INVENTION

An objective of the present invention is to provide an intermittently open experiment apparatus for cracking crude oil to try to simulate a cracking process of crude oil at naturally geological conditions.

In order to solve the above technical problem, the present invention provides a technical solution of an intermittently opened cracking crude oil apparatus. The apparatus comprises a high pressure container, a support post provided within the high pressure container, and a gold sleeve arranged between the high pressure container and the support post. A sealed reaction chamber of natural gas is formed between an exterior surface of the support post and an interior surface of the gold sleeve, and a sealed high pressure chamber is formed between an interior surface of the high pressure container and an exterior surface of the gold sleeve. A gas outlet is provided in the support post and communicates the reaction chamber of natural gas, the gas outlet communicating one end of a gas conduit, the other end of the gas conduit being connected to a natural gas collector via a collection valve. A movable valve needle is provided on the gas outlet to control open and close of the gas outlet. A liquid inlet is provided on the high pressure container and communicates the high pressure chamber, the liquid inlet communicating a liquid conduit which communicates a high pressure liquid supply. A heater and a nozzle of liquid nitrogen are provided outside the high pressure container. A thermocouple is provided on the high pressure container, the thermocouple being connected to a temperature control which can control operating conditions of the heater and the nozzle of liquid nitrogen.

When the present invention is applied, load a sample of crude oil waiting for reaction into the reaction chamber of natural gas, and then close the gas outlet with the movable valve needle. A high pressure liquid enters into the high pressure chamber via the liquid conduit and presses the gold sleeve to deform it, due to the flexibility of the gold. Then the gold sleeve closely clings to the support post and exerts a pressure force on the sample of crude oil, which can truly simulate the geological conditions. The heater is started to heat the sample of crude oil and the heated sample of crude oil begins to crack to generate gas. After finishing the crack, close the heater, remove the high pressure liquid, spray liquid nitrogen by the nozzle of liquid nitrogen to cool the high pressure container, and then open the movable valve needle enclosing the gas outlet, thereby the gas generated by cracking flows into the natural gas collector via the gas outlet and the gas conduit, while un-cracked crude oil is still left in the reaction chamber of natural gas to crack for the next time. The thermocouple can measure a temperature of the high pressure container, and the temperature control controls operating conditions of the heater and the nozzle of liquid nitrogen to heat and cool the high pressure container.

Due to the above structure, the present invention has the following advantages:

1. It is possible to research the quantity, composition and so on of natural gas generate by crude oil at different temperature stages.

2. Naturally geological conditions are relatively truly simulated, since the reaction takes place at a situation with pressure.

3. The reaction container uses a pure gold or gold plated part to avoid catalyses of other metals on cracking oil, due to an inertness of chemical reaction of the gold. Wherein the pure gold sleeve 12 can be melted to reproduce after finishing the reaction, which just needs a little process cost, and thus the cost of experiment is very cheap.

4. The experiment process of the invention is ready to be controlled by a computer procedure, which greatly increase the efficiency and precision of the experiment, and decrease manpower consumption.

Figure 1:
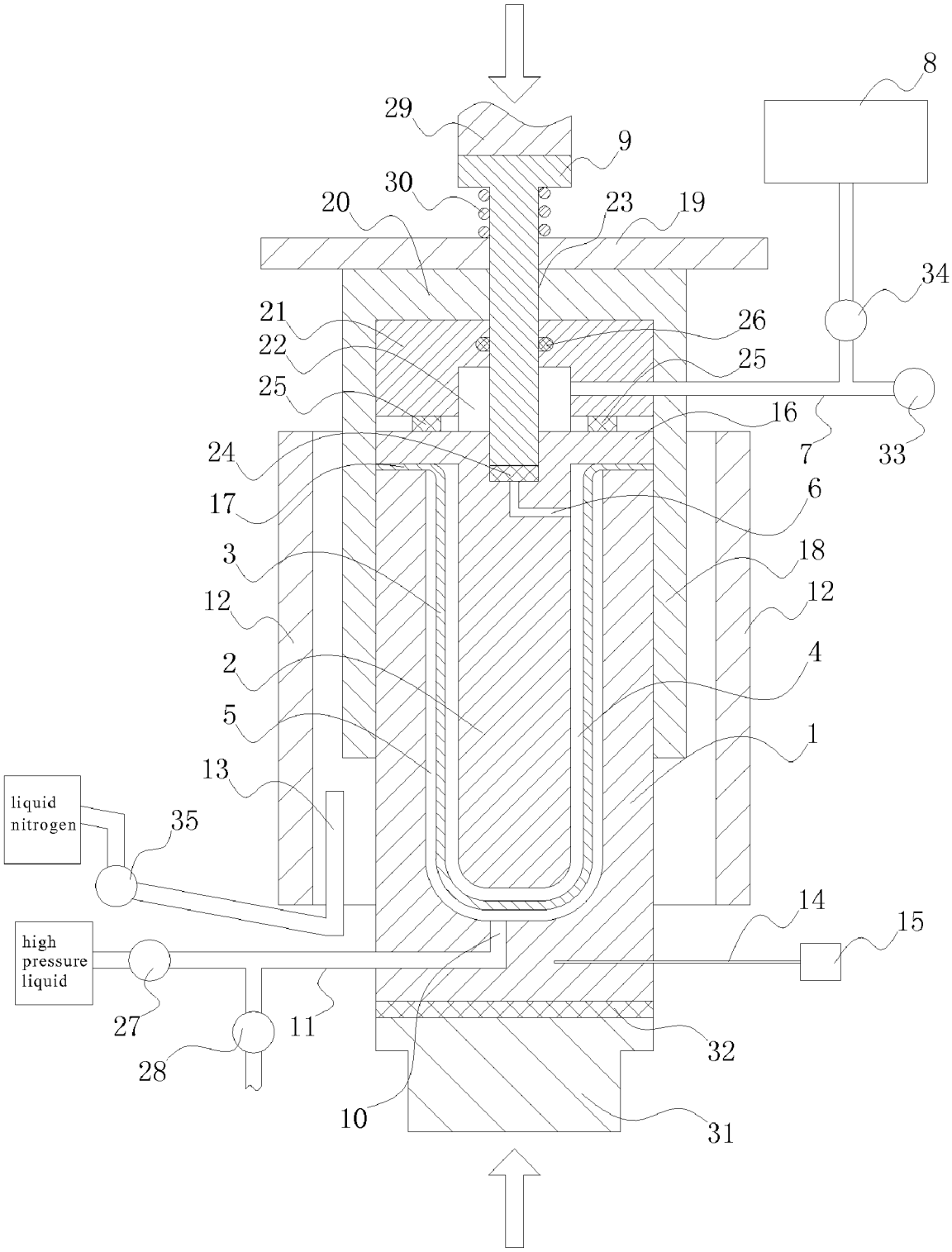
FIG. 1 is a section of an intermittently opened cracking crude oil apparatus.

In the FIGURE including: a high pressure container 1, a support post 2, a gold sleeve 3, a reaction chamber of natural gas 4, a high pressure chamber 5, a gas outlet 6, a gas conduit 7, a natural gas collector 8, a movable valve needle 9, a liquid inlet 10, a liquid conduit 11, a heater 12, a nozzle of liquid nitrogen 13, a thermocouple 14, a temperature control 15, a flange 16, a skirt border 17, a locating cylinder 18, a support frame 19, a limit platform 20, a movable press ring 21, a hollow portion 22, a movable valve needle hole 23, a gold gasket 24, a gold seal ring 25, a graphite seal ring 26, a high pressure valve 27, a drain valve 28, a pneumatic piston rod 29, a spring 30, a piston rod of oil press 31, an asbestos heat insulation pad 32, a vacuum valve 33, a collection valve of natural gas 34, and a liquid nitrogen valve 35.

DETAILED DESCRIPTION OF THE INVENTION

Embodiments of the invention will be described in detail in connection with the accompanying drawing.

Referring to FIG. 1, according to the present invention, an intermittently opened cracking crude oil apparatus comprises a high pressure container 1, a support post 2 provided within the high pressure container 1, and a gold sleeve 3 arranged between the high pressure container 1 and the support post 2. The high pressure container 1 and the support post 2 are made of stainless steel of 316. A sealed reaction chamber of natural gas 4 is formed between an exterior surface of the support post 2 and an interior surface of the gold sleeve 3, and a sealed high pressure chamber 5 is formed between an interior surface of the high pressure container 1 and an exterior surface of the gold sleeve 3. A gas outlet 6 is provided in the support post 2 and communicates the reaction chamber of natural gas 4, the gas outlet 6 communicating one end of a gas conduit 7, the other end of the gas conduit 7 being connected to a natural gas collector 8 via a collection valve 34. A movable valve needle 9 is provided on the gas outlet 6 to control open and close of the gas outlet 6. During cracking process, the movable valve needle 9 closes the gas outlet 6. After finishing the crack process, the movable valve needle 9 opens the gas outlet 6, and the natural gas generated by crude oil cracking flows into the natural gas collector 8 via the gas outlet 6, the gas conduit 7 and the collection valve 34. A liquid inlet 10 is provided on the high pressure container 1 and communicates the high pressure chamber 5, the liquid inlet 10 communicating a liquid conduit 11 which communicates a high pressure liquid supply. The high pressure liquid can be, for example, water. The high pressure liquid enters into the high pressure chamber 5 via the liquid conduit 11 and the liquid inlet 10 and presses the gold sleeve 3 to deform it. Then the gold sleeve 3 closely clings to the support post 2 and exerts a pressure force on the sample of crude oil, which can truly simulate the geological conditions. A heater 12 and a nozzle of liquid nitrogen 13 are provided outside the high pressure container 1. The heater can be a resistance furnace or a high frequency heater. The nozzle of liquid nitrogen 13 is connected to liquid nitrogen supply via a liquid nitrogen valve 35. The heater 12 is applied electrical power to heat the sample of crude oil in the reaction chamber 4 of natural gas inside the high pressure container 1. The liquid nitrogen sprayed by the nozzle of liquid nitrogen 13 can quickly cool the sample of crude oil. A thermocouple (14) is provided on the high pressure container 1, the thermocouple 14 being connected to a temperature control 15 which can control operating conditions of the heater 12 and the nozzle of liquid nitrogen 13. The thermocouple can measure a temperature of the high pressure container, and the temperature control controls operating conditions of the heater and the nozzle of liquid nitrogen to heat and cool the high pressure container, which facilitate the procedure control of temperature.

The support post 2 is provided with a flange 16 on its end to match an opening end surface of the high pressure container 1, and the gold sleeve 3 is provided with a skirt border 17 which is located between the opening end surface of the high pressure container 1 and a bottom surface of the flange 16. A seal effect can be achieved by pressing the flange 16 of the support post 2 and the opening end surface of the high pressure container 1 towards each other to press the skirt border 17 of the gold sleeve 3 from upside and downside, respectively. Thereby, the sealed reaction chamber of natural gas 4 is formed between the exterior surface of the support post 2 and the interior surface of the gold sleeve 3, and the sealed high pressure chamber 5 is formed between the interior surface of the high pressure container 1 and the exterior surface of the gold sleeve 3.

The present invention can further include a locating cylinder 18 and a support frame 19 positioned on the locating cylinder 18. Upper portions of the high pressure container 1 and the support post 2 can be axially movably set inside the locating cylinder 18, and the locating cylinder 18 is provided with a limit platform 20 on its upper end. The support frame 19 is used for fixation of the entire apparatus. When the high pressure container 1 is pushed upwards, the limit platform 20 and the high pressure container 1 cooperate so that the flange 16 and the opening end surface of the high pressure container 1 are pressed opposite to each other. In addition, since the upper portions of the high pressure container 1 and the support post 2 can axially move in the locating cylinder 18, it is very convenient to assembly together and to separate the high pressure container 1, the support post 2, and the gold sleeve 3, in order to wash off and load the sample of crude oil.

A movable press ring 21 is provided within an upper portion of the locating cylinder 18 and is pressed against the gas outlet 6 of the support post 2. A gold seal ring 25 is provided between the movable press ring 21 and the support post 2. The movable press ring 21 is provided with a hollow portion 22 which is positioned over the gas outlet 6 and communicates the gas conduit 7. The movable press ring 21 also is provided with a movable valve needle hole 23 in which the movable valve needle 9 is movably set. The movable valve needle 9 passes through one end of the hollow portion 22 and is pressed against the gas outlet 6. A gold gasket 24 is provided between the movable valve needle 9 and the gas outlet 6. When the movable valve needle 9 is not closely pressed against the gas outlet 6, the gas can flow through the gap between the gas outlet 6 and the gold gasket 24, and into the hollow portion 22, and then exit from the gas conduit 7.

A graphite seal ring 26 is provided between the movable valve needle 9 and the movable valve needle hole 23. The graphite seal ring 26 can maintain seal at high temperature conditions so that the gas can not escape from the gap between the movable valve needle 9 and the movable valve needle hole 23.

A high pressure valve 27 is provided in the liquid conduit 11, and a drain valve 28 is provided in the liquid conduit 11 between the liquid inlet 10 and the high pressure valve 27. As the high pressure valve 27 is opened and the drain valve 28 is closed, the high pressure liquid can flow through the liquid conduit 11 and into the high pressure chamber 5 to apply a pressure force on the reaction chamber of natural gas 4. As the high pressure valve 27 is closed and the drain valve 28 is opened, the high pressure liquid will flow out of the high pressure chamber 5 and consequently the pressure on the reaction chamber of natural gas 4 will disappear.

An upper end of the movable valve needle 9 is connected with a pneumatic piston rod 29, and a spring 30 is provided on the movable valve needle 9 to act on the support frame 19 to move the movable valve needle 9 away from the gas outlet 6. As air is charged into the cylinder of the pneumatic piston rod 29, the pneumatic piston rod 29 will push the movable valve needle 9 downwards and thus the lower end of the movable valve needle 9 will be pressed against the gas outlet 6 to close it. When the gas outlet 6 is required to open, the pneumatic piston rod 29 is lifted and the movable valve needle 9 moves upwards due to the spring 30. As a result, the gold gasket 24 will be no longer pressed against the gas outlet 6 and thus the gas can exit from the gas outlet 6.

The bottom of the high pressure container 1 is connected with a piston rod of oil press 31, and an asbestos heat insulation pad 32 is provided between the high pressure container 1 and the piston rod of oil press 31. After the support frame 2 secures the entire apparatus, the piston rod of oil press 31 move upwards so that the skirt border 17 of the gold sleeve 3 is pressed by the high pressure container 1 and the support post 2 from upside and downside, respectively, to produce hermetical effect. During an experiment, the asbestos heat insulation pad 32 can insulate heat from the piston rod of oil press 31, since the high pressure container 1 has high temperature.

The gas conduit 7 is connected to a vacuum valve 33 which is connected to a vacuum machine. In this manner, the reaction chamber of natural gas 4 can be vacuumized.

A gold plated layer is provided on the exterior surface of the support post 2. Due to the good inertness of the gold plated layer, which does not produce chemical reaction at high temperature, it will have no effect on the experiment's result.

The following is the operating principle of present invention and the experiment's steps:

1. Load a Sample of Crude Oil:
   (1) Release a pressure of an oil press to move the piston rod of oil press 31 downwards and take out the gold sleeve 3 and the support post 2 which have been used.
   (2) Wash the support post 2, use a new gold sleeve 3 and charge into the new gold sleeve 3 the sample of crude oil to react which has been precisely weighed.
   (3) Replace the washed support post 2 and the new gold sleeve 3 with the sample of crude oil as shown.
   (4) Move the piston rod of oil press 31 upwards, and due to the support frame 19 being secured, the skirt border 17 of the gold sleeve 3 is pressed by the high pressure container 1 and the support post 2 from upside and downside, respectively, to produce hermetical effect, which forms the closed reaction chamber of natural gas 4 between the exterior surface of the support post 2 and the interior surface of the gold sleeve 3, the sample of crude oil waiting for reaction being located in the reaction chamber 4.
   (5) By means of the pressure force applied by the pneumatic piston rod 29, move the movable valve needle 9 downwards to closely press against the gold gasket 24 to close the gas outlet 6.
2. Carry Out the Experiment:
   (1) Close the drain valve 28 and open the high pressure water valve 27 to allow the high pressure water to flow into the high pressure chamber 5. Due to the flexibility of the gold, the gold sleeve is deformed by pressing of the outside high pressure water. Then the gold sleeve closely clings to the support post and exerts a pressure force on the sample of crude oil. The purpose of exerting a pressure force on the sample of crude oil is to truly simulate the geological conditions. It should be noted that the pressure of the high pressure water should be less than that of piston rod of oil press 31 to allow the gold sleeve 3 to maintain the good hermetical state.
   (2) Start the heater 12 to raise the temperature of the reaction chamber of natural gas 4 up to 300° C. in 10 minutes and to maintain the constant temperature of 300° C. for 2 hours.
   (3) Close the heater 12 and the high pressure water valve 27, and open the drain valve 28 to discharge the high pressure water.
   (4) Open the liquid nitrogen valve 35 to spray the liquid nitrogen from the nozzle of liquid nitrogen 13 to cool the reaction chamber of natural gas 4 down to −80° C., quickly.
   (5) Close the vacuum valve 33 and open the collection valve of natural gas 34. Release the air pressure of the pneumatic piston rod 29, and consequently, the movable valve needle 9 moves upwards by spring 30, due to no pressure on the upper end of the movable valve needle 9. The natural gas generated in the reaction chamber of natural gas 4 flows through the collection valve of natural gas 34 into the natural gas collector 8 which has been vacuumized in advance.
   (6) Close collection valve of natural gas 34, and remove the natural gas collector 8 to be used for a following analysis. At the same time, use a new natural gas collector 8 which has been vacuumized.
   (7) Open the vacuum valve 33 and exhaust the gas within the reaction chamber of natural gas 4. Because of being cooled, the remaining crude oil still keep in the reaction chamber of natural gas 4 to continue the reaction.
   (8) By means of the pressure force applied by the pneumatic piston rod 29, the movable valve needle 9 is moved downwards to close the gas outlet 6, close the vacuum valve 33, and the liquid nitrogen valve 35, and open the high pressure water valve 27 to complete the first stage of temperature (300° C.) of the experiment.
   (9) Repeat the steps (2) to (8) to maintain the constant temperature of 320° C. This is done successively till the temperature reaches 620° C. and then the experiment is over.

What is claimed is:

1. An intermittently opened cracking crude oil apparatus comprising:

a high pressure container (1);

a support post (2) provided within the high pressure container (1); a gold sleeve (3) arranged between the high pressure container and the support post;

a sealed reaction chamber of natural gas (4) is formed between an exterior surface of the support post (2) and an interior surface of the gold sleeve (3), and a sealed high pressure chamber (5) is formed between an interior surface of the high pressure container (1) and an exterior surface of the gold sleeve (3);

a gas outlet (6) is provided in the support post (2) to communicate the reaction chamber of natural gas (4), the gas outlet (6) communicating one end of a gas conduit (7), the other end of the gas conduit (7) being connected to a natural gas collector (8) via a collection valve (34);

a movable valve needle (9) is provided on the gas outlet (6) to control open and close of the gas outlet (6);

a liquid inlet (10) is provided on the high pressure container (1) and communicates the high pressure chamber (5), the liquid inlet (10) communicates a liquid conduit (11) which communicates a high pressure liquid supply;

a heater (12) and a nozzle of liquid nitrogen (13) are provided outside the high pressure container (1); and a thermocouple (14) is provided on the high pressure container (1), the thermocouple (14) is connected to a temperature control (15) which can control operating conditions of the heater (12) and the nozzle of liquid nitrogen (13).

2. The intermittently opened cracking crude oil apparatus according to claim 1, wherein the support post (2) is provided with a flange (16) on its end to match a opening end surface of the high pressure container (1), and the gold sleeve (3) is provided with a skirt border (17) which is located between the opening end surface of the high pressure container (1) and the flange (16).

3. The intermittently opened cracking crude oil apparatus according to claim 2, wherein the apparatus is further provided with a locating cylinder (18), a support frame (19) positioned on the locating cylinder (18), upper portions of the high pressure container (1) and the support post (2) are axially movably set inside the locating cylinder (18), and the locating cylinder (18) is provided with a limit platform (20) on its upper end.

4. The intermittently opened cracking crude oil apparatus according to claim 3, wherein a movable press ring (21) is provided within an upper portion of the locating cylinder (18), a gold seal ring (25) is provided between the movable press ring (21) and the support post (2), the movable press ring (21) is provided with a hollow portion (22) which is positioned over the gas outlet (6) and communicates the gas conduit (7), the movable press ring (21) is provided with a movable valve needle hole (23) in which the movable valve needle (9) is movably set, the movable valve needle (9) is pressed against the gas outlet (6), and a gold gasket (24) is provided between the movable valve needle (9) and the gas outlet (6).

5. The intermittently opened cracking crude oil apparatus according to claim 4, wherein a graphite seal ring (26) is provided between the movable valve needle (9) and the movable valve needle hole (23).

6. The intermittently opened cracking crude oil apparatus according to claim 1, wherein a high pressure valve (27) is provided in the liquid conduit (11) and a drain valve (28) is provided in the liquid conduit (11) between the liquid inlet (10) and the high pressure valve (27).

7. The intermittently opened cracking crude oil apparatus according to claim 3, wherein an upper end of the movable valve needle (9) is connected with a pneumatic piston rod (29), a spring (30) is provided on the movable valve needle (9) to act on the support frame (19) to move the movable valve needle (9) away from the gas outlet (6).

8. The intermittently open cracking crude oil apparatus according to claim 3, wherein the bottom of the high pressure container (1) is connected with a piston rod of oil press (31), and that an asbestos heat insulation pad (32) is provided between the high pressure container (1) and the piston rod of oil press (31).

9. The intermittently opened cracking crude oil apparatus according to claim 1, wherein the gas conduit, the natural gas collector and the collection valve of gas (34) are all connected with a vacuum valve (33).

10. The intermittently opened cracking crude oil apparatus according to claim 1, wherein a plated gold layer is provided on the exterior surface of the support post (2).

11. The intermittently opened cracking crude oil apparatus according to claim 4, wherein a high pressure valve (27) is provided in the liquid conduit (11) and a drain valve (28) is provided in the liquid conduit (11) between the liquid inlet (10) and the high pressure valve (27).

12. The intermittently opened cracking crude oil apparatus according to claim 4, wherein the gas conduit, the natural gas collector and the collection valve of gas (34) are all connected with a vacuum valve (33).

13. The intermittently opened cracking crude oil apparatus according to any one of claim 4, wherein a plated gold layer is provided on the exterior surface of the support post (2).

* * * * *